US009676601B2

(12) United States Patent
Magni

(10) Patent No.: US 9,676,601 B2
(45) Date of Patent: Jun. 13, 2017

(54) GRIPPING MEANS FOR OUTFITTING VEHICLES FOR HANDLING LOADS

(71) Applicant: C.M.C. S.R.L.—SOCIETA UNIPERSONALE, Castelfranco Emilia, Modena (IT)

(72) Inventor: Riccardo Magni, Modena (IT)

(73) Assignee: C.M.C. S.R.L.—SOCIETA UNIPERSONALE, Modena (IT)

( * ) Notice: Subject to any disclaimer, the term of this patent is extended or adjusted under 35 U.S.C. 154(b) by 0 days.

(21) Appl. No.: 14/896,904

(22) PCT Filed: Jun. 3, 2014

(86) PCT No.: PCT/IB2014/000931

§ 371 (c)(1),
(2) Date: Dec. 8, 2015

(87) PCT Pub. No.: WO2014/199209

PCT Pub. Date: Dec. 18, 2014

(65) Prior Publication Data

US 2016/0152456 A1 Jun. 2, 2016

(30) Foreign Application Priority Data

Jun. 10, 2013 (IT) ..... MO2013A0168

(51) Int. Cl.
*B66F 9/18* (2006.01)
*B66F 9/065* (2006.01)
*B66F 9/12* (2006.01)

(52) U.S. Cl.
CPC ..... *B66F 9/18* (2013.01); *B66F 9/065* (2013.01); *B66F 9/0655* (2013.01); *B66F 9/125* (2013.01); *B66F 9/184* (2013.01)

(58) Field of Classification Search
CPC ..... B66F 9/065; B66F 9/0655; B66F 9/125; B66F 9/18; B66F 9/184; B66C 1/427; B66C 1/447
(Continued)

(56) References Cited

U.S. PATENT DOCUMENTS 3,112,830 A * 12/1963 Podlesak ..... B66C 13/18 294/106
3,561,615 A * 2/1971 Forsberg ..... F16L 1/09 29/237
(Continued)

FOREIGN PATENT DOCUMENTS

JP 02-132100 A 5/1990

OTHER PUBLICATIONS

International Search Report of PCT/IB2014/000931 dated Sep. 3, 2014.

*Primary Examiner* — Dean Kramer
(74) *Attorney, Agent, or Firm* — Arent Fox LLP

(57) ABSTRACT

A gripping apparatus for outfitting vehicles for handling loads include a structure, which can be removably coupled with an operating arm of a vehicle for handling of loads. It includes: a support element which comprises a coupling base for connection with a corresponding coupling head which is fitted to the operating arm, a holding element which is fixed to the coupling base and can rotate, on command, with respect to the coupling base and about a first axis. The holding element is provided with a load gripping apparatus for gripping a load. A load handled by the load gripping apparatus can translate along a predetermined direction contained in a plane extending perpendicularly with respect to the first axis.

16 Claims, 4 Drawing Sheets

(58) Field of Classification Search
USPC ..... 294/86.41, 81.4, 81.61, 81.62; 414/731, 414/732
See application file for complete search history.

(56) References Cited

U.S. PATENT DOCUMENTS

| | | | | |
|---|---|---|---|---|
| 5,219,265 | A * | 6/1993 | Recker | E02F 3/963 294/115 |
| 6,280,119 | B1 | 8/2001 | Ryan et al. | |
| 8,146,971 | B2 * | 4/2012 | LaValley | E21B 19/14 294/81.61 |
| 2010/0158654 | A1 | 6/2010 | Willim | |
| 2011/0103927 | A1 | 5/2011 | Magni | |

* cited by examiner

GRIPPING MEANS FOR OUTFITTING VEHICLES FOR HANDLING LOADS

CROSS-REFERENCE TO RELATED APPLICATION

This application is a National Stage entry of International Application No. PCT/IB2014/000931, filed Jun. 3, 2014, which claims priority to Italian Patent Application No. MO2013A000168, filed Jun. 10, 2013. The disclosures of the priority applications are incorporated in their entirety herein by reference.

The object of the present invention is to propose gripping means for outfitting vehicles for handling loads.

In particular, but not exclusively, the present invention can be advantageously used for local handling of loads having overall cylindrical shape, such as hydraulic cylinders or other parts of earthmoving machines used in mines or the like.

Such applications often use earthmoving big dimension and capacity machines, which are used to move, dig and transport great quantities of earth and/or rocks. It is so in the case of big, self-propelled excavator machines on wheels or tracks, which are provided with shovels or buckets, connected to the machine body by means of extendable articulated arms, which are aimed particularly at operating the shovel or a bucket to excavate and/or to load material, for example on the transport means, often consisting of huge dumpers. The extendable articulated arms, with which such machines are equipped, are operated by means of suitable hydraulic actuators which, in this case, are particularly distinguished by considerable dimensions and weight. For example, one of the actuators used to operate the articulated arm of this type of machine can have a length of several meters and a diameter of tens of centimeters. This means that an actuator of this type, substantially constituted by a cylindrical body, has a rather considerable weight. Moreover, the positions of such actuators, with respect to the articulated arm that they are to operate, are very difficult to accede also because of their orientation, that is of the position of their axis, which is normally inclined with respect to the vertical.

Taking into consideration the above, the dimensions and considerable weight of such actuators, their removal and re-mounting from/to the earthmoving machine to which they are fitted, is dangerous and not simple and requires a significant length of time. It is also to be reminded that such removal and re-mounting operations must be performed with a certain frequency due to the rather aggressive environmental conditions, in which the earthmoving machines with the actuators must work during their normal working life.

For example, in order to remove such an actuator, it is obviously necessary to assure, first of all, a strong and secure support for the actuator. Then the mechanical connections situated at the ends of the actuator can be removed, after having disconnected various hydraulic connections. Therefore, the whole actuator must be suitably supported and kept perfectly in position. This allows the operators to disconnect safely and without any difficulty the pins, which connect the actuator with the articulated arm of the earthmoving machine.

The prior art has tried to realize such a condition by gripping the actuator body with suitable pliers. The pliers are operated by a suitably strong mechanical arm and act by tightening the cylindrical body of the actuator, to keep it in place and afterwards to allow it to move.

Such arrangements proposed by the prior art have shown not to be able to offer a satisfying solution to the problem of strong gripping, and, first of all, maintaining a certain and secure positioning of the actuator.

The object of the present invention is to overcome the above reported problems and drawbacks of the prior art, by proposing gripping means (also interchangeably referred to herein as a grappling arm) for outfitting vehicles for handling loads (also interchangeably referred to herein as a telescopic loader).

The object of the present invention is to overcome the above reported problems and drawbacks of the prior art, by proposing gripping means for outfitting vehicles for handling loads.

According to another object, the present invention is structured in such a way as to allow the use, in an interchangeable way, of different gripping means, which can be employed to support different kinds of devices.

In particular, the present invention proposes gripping means for outfitting vehicles for handling loads that allow easy gripping as well as rapid and secure handling of loads.

The above mentioned and other objects are obtained by the present invention as described, characterized and claimed in the following.

The advantages of the present invention derive from its constructive simplicity, low costs and reduced dimensions.

Other characteristics and advantages of the present invention will become more evident from the following detailed description of some of its preferred, but not exclusive embodiments, illustrated as a pure and not limiting example in the enclosed figures, in which.

The above mentioned Figures show gripping means for outfitting vehicles for handling loads.

Figure 1:
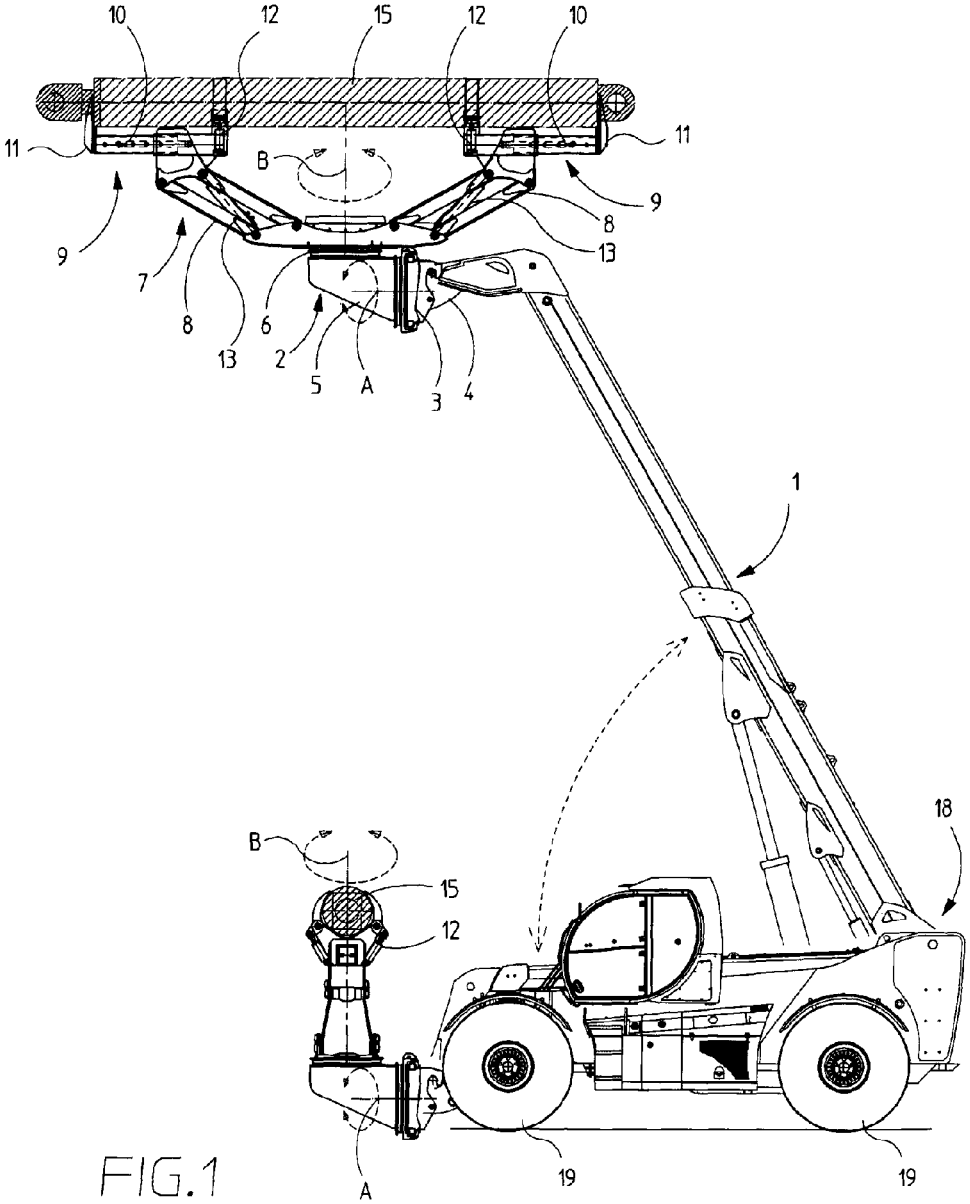
FIG. 1 is a side view of a first embodiment of a vehicle for handling loads as a whole, which is shown in two different working configurations.
Figure 2:
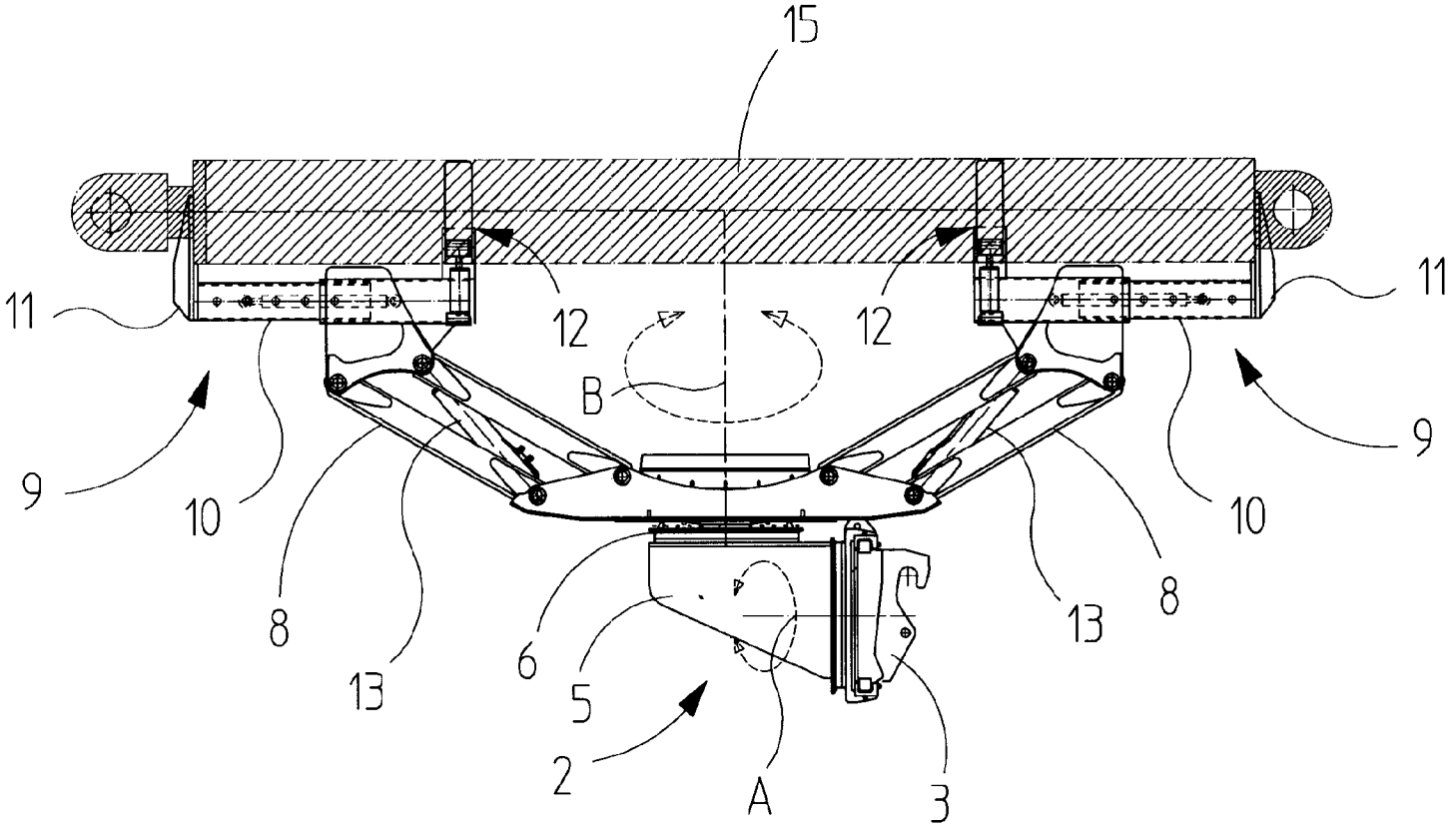
FIG. 2 shows a particular of FIG. 1 in enlarged scale.
Figure 3:
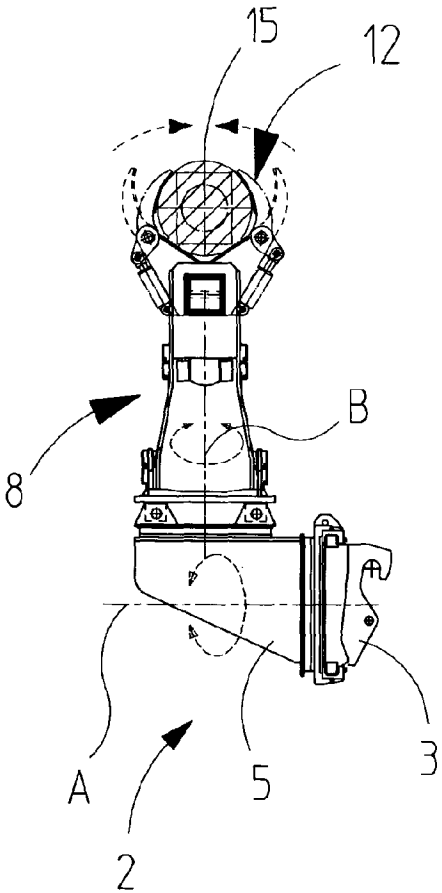
FIG. 3 is the same view as FIG. 2 with gripping arms 8 rotated by 90° about the axis B.
Figure 4:
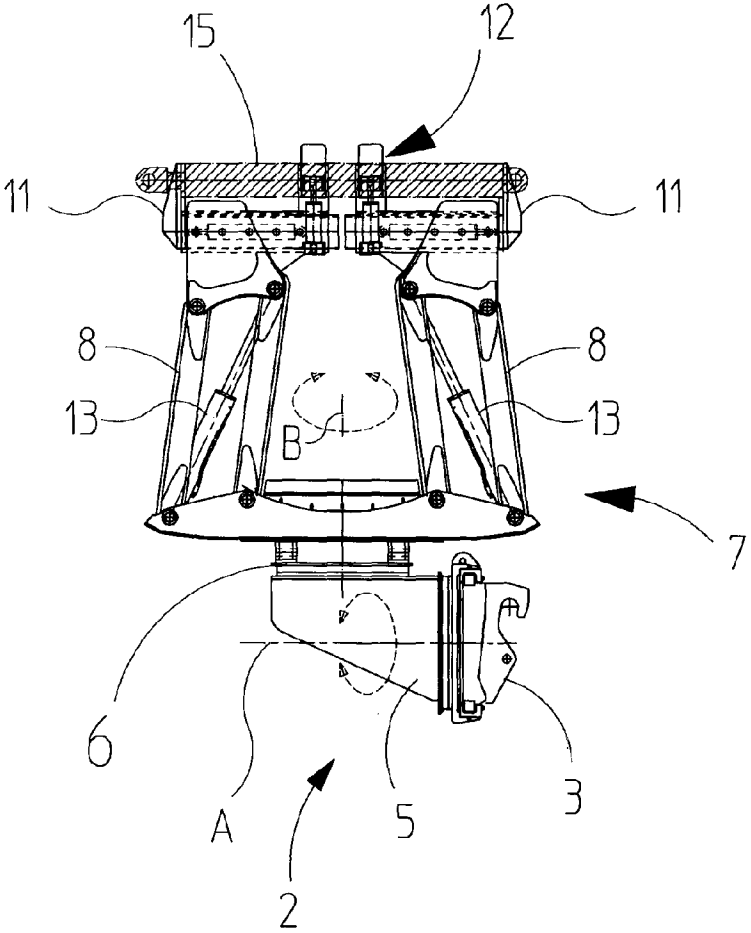
FIG. 4 shows the particular of FIG. 2 used to grip a cylindrical load of smaller dimensions.
Figure 6:
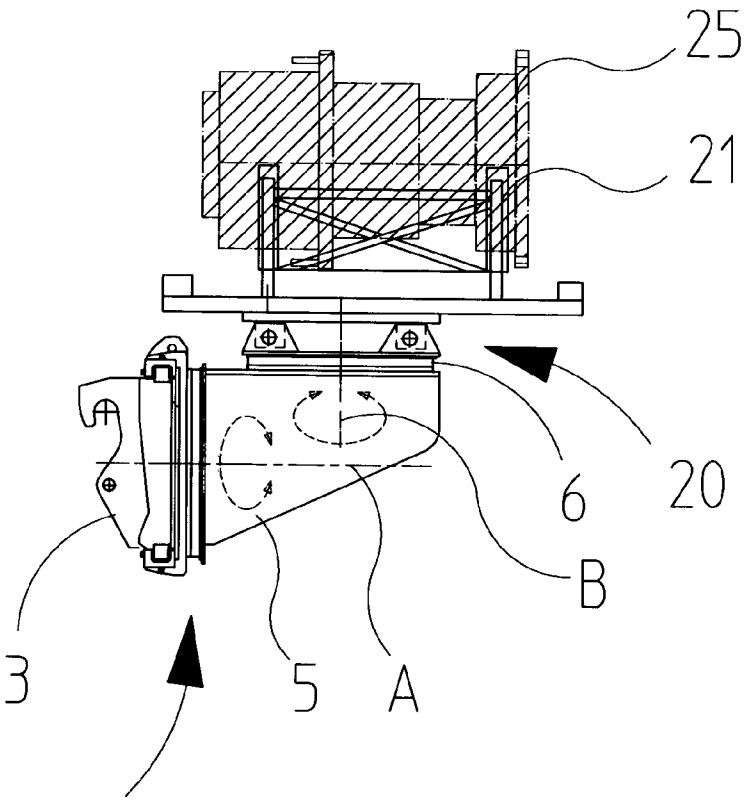
FIG. 6 shows a part of a schematic side view of another embodiment.
Figure 5:
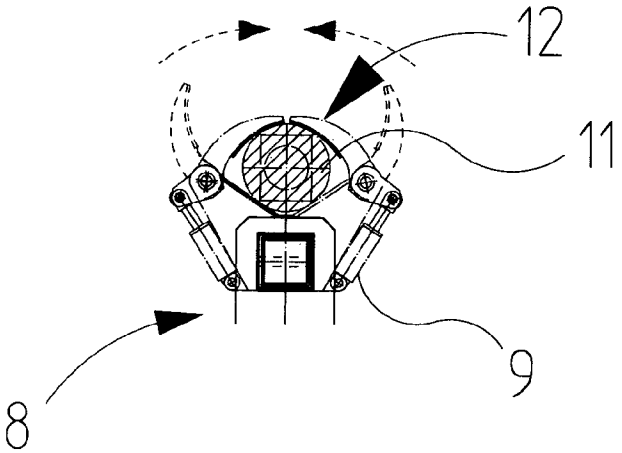
FIG. 5 shows a portion of FIG. 4 with the gripping arms 8 rotated by 90° about the axis B.

With particular reference to FIG. 1, the vehicle shown therein consists of a self-moving vehicle, which moves on wheels 19 and is provided with a frame 18. On the rear part of the frame, there is fastened the base of a telescopic operating arm 1, which supports a coupling head 4 at the top. The latter is arranged to allow rapid locking (and unlocking) of tools which are then operated through the activation of the operating arm 1, suitably dimensioned to carry loads of a predetermined entity.

Said gripping means comprise a structure which can be coupled to the operating arm 1 in a removable way, and which is provided with a coupling base 3 (also referred to interchangeably herein as a coupling portion) for coupling with the operating arm 1. The same gripping means are aimed at gripping and stably carrying loads 15 and can be operated to perform movements on their own, at least about two not parallel rotation axes, so as to be placed, on command, in the position suitable to grip correctly the load 15.

After having been firmly gripped, the load 15 is further moved using the moving capacities of the operating arm 1 and the vehicle, on which it is mounted.

In particular, the above mentioned structure of said gripping means, which can be removably coupled to the operating arm 1, is provided with a support element 2. The coupling base 3 is fastened to the support element for rapid connection with the coupling head 4, which is fitted to the operating arm 1.

The support element 2 also comprises a holding element 5, which is fastened to the coupling base 3 by means of a rotary coupling. In this way, the holding element 5 can rotate, upon command, with respect to the coupling base 3 on an axis A.

The holding element 5 (also referred to interchangeably herein as a rotating base) is bound to the gripping means indicated as a whole with 7, by means of a rotating platform 6, which can be rotated upon command about an axis B, transversal with respect to the axis A. In the illustrated embodiment, the axis B and the axis A are perpendicular.

An arm mounting base 22, having attachment points for articulated arms 8 (also referred to interchangeably herein as a first and second arm portion), is connected to the rotating platform 6. The gripping means 7 include two gripping units 9, fastened to the two ends of the two articulated arms 8, each of the two articulated arms may comprise a pair of arms, which are configure to move close to and away from each other on command allowing the gripping units (9) to travel along a path within a plane extending perpendicularly to the first axis A.

As shown in FIGS. 1-4, each gripping unit 9, in turn, includes, fastened to a central element 10, an axial stop element 11, aimed at acting in correspondence to an end of the load 15, and a pliers member 12 designed to act surrounding at least partially the load 15 in an intermediate position. The central element 10, may further comprise an inner central element and an outer central element. The outer central element may be hollow and dimensioned to house the inner central element. The inner central element and outer central element and outer central element may be coaxially arranged and at least part of the inner central element and outer central element may overlap in a the axial direction; accordingly, the inner central element may be telescopically movable so that a distance between the pliers member 12 and axial stop element 11 may be adjustable.

The axial stop elements 11 of the two gripping units 9 are arranged in a substantially symmetrical way with respect to a middle plane containing the axis B, perpendicular with respect to the axis A. The holding element 5 can rotate about axis A with respect to the coupling base 3. In any way, the axial stop elements 11 of the two gripping units 9 are reciprocally arranged in such a way as to perform their stopping action on each load 15 in opposite directions.

The load (15) held by each gripping unit (9) can also translate, upon command, with respect to the coupling base 3 in a prefixed motion line, which is contained in a plane perpendicular to the axis A, on which said holding element (5) can rotate with respect to the coupling base (3).

The axis B, about which the gripping means 7 can rotate upon command, by means of the rotating platform (6), is perpendicular with respect to said axis A, on which the holding element 5 can rotate with respect to the coupling base 3. The two articulated arms 8 are formed by articulated parallelograms, which are operated by means of linear actuators 13.

Each of the axial stop elements 11 of each of the two gripping units 9 is operated to move axially by hydraulic actuators; these actuators act between each stop element 11 and a first portion of the respective central element 10, fixed to the corresponding end of the corresponding articulated arm 8.

Each pliers member 12 is formed by two jaws, operated by hydraulic means.

The pliers member 12 and the respective jaws are designed and dimensioned so as to surround and hold the loads 15, at intermediate positions of the respective lateral surfaces, which have a cylindrical shape. This because the loads 15 are substantially hydraulic cylinders.

Each central element 10 consists of a first portion, fixed to the corresponding end of the corresponding articulated arm 8 and supporting, solidly fixed thereto, the respective pliers member, and a second portion, to which the corresponding axial stop element 11 is fastened. Said first and second portion are reciprocally fastened in a telescopic way, by means of a hydraulic actuator situated at their inside.

Because the gripping means 7 can perform, upon command, the combined movements, it is possible to position them spatially in such a way as to put them perfectly beside the cylindrical load 15, to be gripped and moved freely, after being removed from the machine.

The grip obtained by the invention is safe, since it is assured in transversal direction by the pliers member 12, and in the longitudinal direction, that is along the axis of the cylindrical actuator which constitutes the load 15, by the axial stop members 11. The axial stop members act just on both the "ends" of the cylindrical actuator in opposite directions, thus preventing any possible withdrawal of the pliers member 12.

In this regard, it is to be noted that the safety and strength of the grip, as well as the positioning in the axial direction of the cylindrical load 15, do not depend entirely on the entity of the tightening force of the pliers member 12. This means that, in the presence of very heavy cylindrical loads, as it occurs with the preferred embodiments of the invention, it is not necessary to use a rather strong pliers member, capable of applying strong tightening forces on the lateral surface of the load.

In fact, according to the invention the pliers member need only to perform actions suitable to keep the load steady, preventing it from moving transversal to its axis.

It is possible to precisely position the gripping means with respect to the loads 15 to be mounted or removed on/from the earthmoving machine, by rotating movements of the holding element 5 about the axes A and B and translation movements in the direction perpendicular to the axis A.

Moving close and away, as well as positioning in height are easily performed using the vehicle and its operating arm 1.

In a second embodiment of the invention, the holding element 5 can be provided with means, which for gripping a load 25, also of an overall cylindrical shape, and which include connection means 20 aimed at allowing quick connection of the tools 21 for supporting loads 25.

In this case, the holding element 5 is provided with means for gripping or simply carrying a load (25), and which include connection means 20 for quick connection of the tools 21, for supporting loads 25 of an overall cylindrical shape, such as wheel hubs and the like.

The invention claimed is:

1. A gripping apparatus for outfitting vehicles for handling loads including a structure, which can be removably coupled with an operating arm of a vehicle for handling loads, comprising: a support element, which includes a coupling base for connection with a corresponding coupling head which is fitted to said operating arm, said support element comprising a holding element which is fastened to the coupling base and can rotate, on command, with respect to said coupling base about a first axis, said support element being provided with a load gripping apparatus being configured so as to enable grip of said load; characterized in that said holding element is fastened to a load gripping portion by means of a rotating platform, which can be operated, upon command, to perform rotations about a second axis, said load gripping portion including two gripping units, fastened to two ends of two articulated arms configured to move mutually close and away from one another on command so as to enable the gripping units to translate along a prefixed motion line contained in a plane extending perpendicularly with respect to said first axis; each of said gripping units comprising, a central element, and an axial stop element, acting in correspondence to an end of the load and a pliers portion, designed to act by surrounding at least partially the load at an intermediate position; the axial stop elements of said two gripping units being arranged symmetrical with respect to a middle plane containing the second axis, transversal with respect to said first axis, about which said holding element can rotate with respect to the coupling base.

2. The gripping apparatus according to claim 1, characterized in that the prefixed motion line contained in a plane arranged perpendicular to said first axis, along which the gripping units can translate upon command, is perpendicular with respect to said first axis, on which said holding element can rotate with respect to the coupling base.

3. The gripping apparatus according to claim 2, characterized in that the second axis, on which the load gripping portion is rotated, upon command, by means of the rotating platform, is perpendicular with respect to said first axis, on which said holding element can rotate with respect to the coupling base.

4. The gripping apparatus according to claim 3, characterized in that said two articulated arms consist of articulated parallelograms, which are operated by linear actuators.

5. The gripping apparatus according to claim 4, characterized in that each of the axial stop elements of each of said two gripping units is operated to move axially by hydraulic actuators, which act between each stop element and a first portion of the respective central element, fixed to the corresponding end of the corresponding articulated arm, with each of said pliers portions being formed by two jaws operated by hydraulic actuators.

6. The gripping apparatus according to claim 5, characterized in that each central element consists of said first portion fixed to the corresponding end of the corresponding articulated arm, and supporting, solidly fastened thereto, the respective pliers portion, and a second portion, to which the corresponding axial stop element is fastened; said first and second portion being reciprocally fastened in a telescopic way.

7. The gripping apparatus according to claim 1, characterized in that said holding element includes a connection portion for quick connection of the load gripping apparatus.

8. A grappling arm for use with a telescopic loader having a telescopically extendable operating arm, the grappling arm comprising:

a rotating platform, rotating about a first axis, coupled to an arm mounting base;

a first articulated arm portion pivotally mounted at a first end to the arm mounting base;

a second articulated arm portion pivotally mounted at a first end to the arm mounting base;

a first gripping unit pivotally mounted to a second end of the first articulated arm portion;

a second gripping unit pivotally mounted to a second end of the second articulated arm portion;

wherein the rotating platform is rotatably connected to a rotating base; wherein each of the first and second gripping units further comprises:

a central element having a first end and a second end;

a pliers member at the first end of the central element;

a stop element at the second end of the central element, wherein each of the first and second articulated arm portions pivot at the first end and at the second end such that the gripping units are configured to travel along a path within a plane extending perpendicularly to the first axis.

9. The grappling arm according to claim 8, wherein each of the first and second articulated arm portions further comprises:

a first linkage having a first end pivotally connected to the arm mounting base and a second end pivotally connected to the gripping unit;

a second linkage having a first end pivotally connected to the arm mounting base and a second end pivotally connected to the gripping unit;

a linear actuator connecting one end of the first linkage and one end of the second linkage.

10. The grappling arm of claim 9, wherein the linear actuator is a hydraulic actuator.

11. The grappling arm according to claim 8, wherein each pliers member includes two gripping portions.

12. The gripping apparatus according to claim 11, wherein each gripping portion is movable, and wherein the movement of each gripping portion is controlled by at least one hydraulic actuator.

13. The gripping apparatus according to claim 8, wherein the rotating base is rotatably connected to a coupling portion, wherein the rotating base pivots in relation to the coupling portion about a second axis perpendicular to the first axis; wherein the coupling portion is mountable to a coupling head of the operating arm of the telescopic loader.

14. The grappling arm according to claim 8, wherein the distance between the pliers member and the stop element of the first gripping unit is adjustable.

15. The grappling arm according to claim 8, wherein the distance between the pliers member and the stop element of the second gripping unit is adjustable.

16. The grappling arm according to claim 8, wherein the central element of each of the first and second gripping units further comprises:

an inner central element; and a hollow outer central element, wherein the inner central element is coaxially arranged and at least partially overlaps the outer central element in an axial direction, and allows for telescopic adjustment of the distance between the pliers member and the stop element.

* * * * *